US010928147B2

(12) United States Patent
Lindstroem

(10) Patent No.: US 10,928,147 B2
(45) Date of Patent: Feb. 23, 2021

(54) METHOD AND LAUNCHER FOR LAUNCHING A PROJECTILE

(71) Applicant: SAAB AB, Linkoeping (SE)

(72) Inventor: Mathias Lindstroem, Hallsberg (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/469,299

(22) PCT Filed: Dec. 8, 2017

(86) PCT No.: PCT/SE2017/051240

§ 371 (c)(1),
(2) Date: Jun. 13, 2019

(87) PCT Pub. No.: WO2018/117941

PCT Pub. Date: Jun. 28, 2018

(65) Prior Publication Data

US 2020/0033078 A1 Jan. 30, 2020

(30) Foreign Application Priority Data

Dec. 21, 2016 (SE) ..... 1600349

(51) Int. Cl.
*F41A 1/10* (2006.01)
*F42B 5/05* (2006.01)
*F42B 5/10* (2006.01)

(52) U.S. Cl.
CPC ..... *F41A 1/10* (2013.01); *F42B 5/05* (2013.01); *F42B 5/105* (2013.01)

(58) Field of Classification Search
CPC ..... F41A 1/10; F42B 5/05; F42B 5/105
(Continued)

(56) References Cited

U.S. PATENT DOCUMENTS 3,750,979 A * 8/1973 Nelms ..... F42B 5/10 244/3.24
4,643,071 A * 2/1987 Baechler ..... F41A 1/10 89/1.701

(Continued)

FOREIGN PATENT DOCUMENTS

DE 1012849 B 7/1957
DE 1941897 A1 3/1971

(Continued)

OTHER PUBLICATIONS

International Searching Authority, International Search Report and Written Opinion for International Application No. PCT/SE2017/051240, dated Feb. 22, 2018, 10 pages, Swedish Patent and Registration Office, Stockholm, Sweden.

(Continued)

*Primary Examiner* — Samir Abdosh
(74) *Attorney, Agent, or Firm* — Alston & Bird LLP

(57) ABSTRACT

The invention relates to a method for launching a projectile and a launcher comprising a barrel (1) accommodating a. a projectile (2); b. a rocket motor (13) at the rear end of the projectile (2) comprising a first compartment containing a first propellant; c. a countermass (3) at the rear end of the barrel (1); and d. a second compartment between the rocket motor (13) and the countermass (3) containing a second propellant, wherein said first and second compartments form a high pressure chamber (6) subsequent to firing of the projectile (2).

12 Claims, 4 Drawing Sheets

(58) Field of Classification Search
USPC ..... 89/1.701
See application file for complete search history.

(56) References Cited

U.S. PATENT DOCUMENTS

| | | | | |
|---|---|---|---|---|
| 4,676,136 | A * | 6/1987 | Kalin | F41A 1/10 89/1.701 |
| 5,285,713 | A | 2/1994 | Brage | |
| 9,441,894 | B1 * | 9/2016 | Moy | F41A 1/10 |
| 9,631,882 | B2 * | 4/2017 | Grant | F41A 1/10 |
| 10,488,127 | B2 * | 11/2019 | Jezierski | F41A 1/10 |
| 2009/0031912 | A1 | 2/2009 | Gilbert | |

FOREIGN PATENT DOCUMENTS

| | | | |
|---|---|---|---|
| EP | 0270781 | A2 | 6/1988 |
| EP | 1337750 | B1 | 7/2006 |
| EP | 1470382 | B1 | 6/2015 |
| EP | 3091326 | A1 | 11/2016 |
| FR | 2260078 | A1 | 8/1975 |
| RU | 2349857 | C2 | 3/2009 |

OTHER PUBLICATIONS

European Patent Office, Extended European Search Report received for Application No. 17883369.5, dated Jul. 10, 2020, 8 pages, Germany.

* cited by examiner

METHOD AND LAUNCHER FOR LAUNCHING A PROJECTILE

CROSS REFERENCE TO RELATED APPLICATIONS

This application is a National Stage Application, filed under 35 U.S.C. 371, of International Application No. PCT/SE2017/051240, filed Dec. 8, 2017, which claims priority to Swedish Application No. 1600349-3, filed Dec. 21, 2016; the contents of both of which are hereby incorporated by reference in their entirety.

BACKGROUND

Related Field

The present invention relates to a method for launching a projectile from a launcher and a launcher as such accommodating components as specified below.

DESCRIPTION OF RELATED ART

A number of methods for launching a projectile from shoulder-fired support weapons are known in the art, for example rocket-propelled, inter alia recoilless back blast launchers or launchers working according to the Davis-Gun principle involving a countermass. Whereas these methods involve various benefits, they also have a negative impact on other parameters such as high acoustic pressure and needs for longer barrels and heavier weapons. As an example, it is difficult to achieve a combination of high velocity of the projectile and a low acoustic pressure. Rocket launching generally results in low stress caused by acceleration, workable acoustic pressure levels, but low velocities of the projectile. This principle is disclosed in e.g. RU2349857 relating to a method of launching a grenade involving a rocket motor thrust. The Davis-Gun principle results in high stress, low acoustic pressure and needs a longer passway for the countermass in the barrel. Of this reason, a longer barrel and heavier countermass may be demanded resulting in less user-adapted solutions. Recoilless back blast launchers typically have low weights resulting in high velocities of the projectile, but high stress and very high acoustic pressure. The present invention intends to alleviate the drawbacks of the above launching methods. In particular, the present invention intends to provide a new launching method improving the acceleration in the barrel. A further objective of the invention is to accelerate or at least retain the velocity of a projectile in its trajectory for a longer period of time. A further objective of the invention is to reduce stress on the barrel. Yet a further objective of the invention is to utilize more of the barrel length for acceleration of the projectile and thereby increase the velocity of the projectile in the internal ballistics phase.

BRIEF SUMMARY

The present invention relates to a method for launching a projectile from a barrel accommodating a. a projectile;
b. a rocket motor at the rear end of the projectile comprising a first compartment containing a first propellant;
c. a countermass at the rear end of the barrel; and
d. a second compartment between the rocket motor and the countermass containing a second propellant, wherein said first and second compartments form a high pressure chamber subsequent to firing of the projectile;

i) wherein combustion gases originating from propellants contained in said first and second compartments in said high pressure chamber accelerate the projectile in the firing direction and the countermass in the opposite direction towards a breech; and
ii) wherein the pressure in the high pressure chamber falls in the second compartment to a level below the pressure in the first compartment when the countermass leaves the barrel; and
iii) wherein said first compartment upholds substantially the originally formed high pressure, preferably ranging from 20 MPa to 60 MPa by means of an opening of said first compartment, preferably a nozzle, delimiting the exhaust of gases from the first compartment to the second compartment, thus enabling continued acceleration of the projectile after the countermass has exited the barrel.

By the wording "upholds substantially the originally formed high pressure before the countermass has left the barrel" is meant the pressure is maintained at the formed high pressure or at a level slightly below the highest pressure obtained in the high pressure chamber, preferably at least 60% or at least 80% or most preferably at least 90% of the originally formed high pressure.

According to one embodiment, it is to be understood that the method of launching the projectile comprises firing the projectile.

It has been found launching, in particular acceleration, of a projectile is considerably improved by combining the Davis-Gun and the rocket-propelled acceleration principles in accordance with the present invention.

According to one embodiment, the rocket motor, typically a conventional launching rocket motor, comprise an opening such as a nozzle for exhausting combusted gases from the first compartment. The nozzle may take any suitable shapes and dimensions depending on ballistic demands, for example as further disclosed in EP 1 337 750. According to one embodiment, the opening is a ring nozzle, preferably arranged to said first compartment enclosing said first propellant. The nozzle can preferably be of bell-shaped or cone-shaped type. Preferably, there can be any number of nozzles as long as the combined throat area is suitable. Preferably, the high pressure chamber can allow for a large expansion factor, but may be limited by the diameter of the launch tube and needs a large throat to permit a high mass flow.

According to one embodiment, to increase a projectile's momentum 125 Ns, with a propellant with a $I_{SP}$=2100 Ns/kg, approximately 60 g propellant may be needed. The required mean mass flow for an action time of 5 ms is then 12 kg/s. With an assumed characteristic velocity C*=1520 m/s for the propellant and a mean chamber pressure of 40 MPa, the nozzle will have a throat diameter of 24 mm. The skilled person would depending on the desired performance be able to select parameters such as propellant, pressure, mass flow etc and from this information design any suitable nozzle. According to one embodiment, the throat diameter of an opening such as a nozzle ranges from 10 to 35 mm, for example from 20 to 30 mm.

When the first and second propellants are initiated, preferably by a conventional ignition system, the gas pressure rises so as to form a high pressure chamber. The projectile and the countermass are thereby accelerated by combustion gases originating from the first and second propellants.

According to one embodiment, a portion of the propellant gases is evacuated from the high pressure chamber through gas channels, for example adapted overflow channels. Such gas channels may regulate the built-up pressure in the high pressure chamber accelerating countermass and projectile. According to one embodiment, a low pressure chamber is in communication with the high pressure chamber via gas channels so that combustion gases may be vented and conducted as further disclosed in EP1470382. Such embodiment may balance the pressure in the high pressure chamber and the acceleration of countermass and projectile. The internal ballistics can also be controlled by e.g. the amount of propellant, selection of propellant and rate of combustion of the propellant.

According to one embodiment, one or several igniters for igniting the propellants are provided. Preferably, the propellant in the first compartment is initiated subsequent to the initiation of the propellant in the second compartment.

According to one embodiment, the density of the countermass ranges from 2 kg/dm$^3$ to 6 kg/dm$^3$, preferably 4 kg/dm$^3$ to 5 kg/dm$^3$.

According to one embodiment, a cartridge case extends coaxially within the barrel from the rear end of the projectile to the rear end of the countermass along or substantially along the inner diameter of the barrel. According to one embodiment, the section of the cartridge case enclosing the countermass is divided into a front section and a rear section. Preferably, the rear section has a weaker construction than the front section to provide an optimized strength distribution.

According to one embodiment, the front section of the countermass container is provided with splines to create ducts between the front end of the front section and the front end of the rear section. According to one embodiment, the splines are arranged around the front section in a longitudinal direction and preferably evenly distributed around the front section.

According to one embodiment, the countermass is formable such as a solid material of particles of a suitable size. According to one embodiment, the countermass is a solid material such as grit, for example a metal grit such as steel grit and/or aluminium grit. Examples of other solid materials include plastic materials such as plastic balls. Preferably the particle size of e.g. grits and/or balls ranges from 20 μm to 250 μm, most preferably from 50 μm to 100 μm.

When the countermass has exited the barrel, a pressure drop occurs in the first and second compartments making up the high pressure chamber. Due to the combustion of propellant in the first compartment and the opening delimiting the exhaust of combusted gases from the first compartment, a pressure as specified herein is upheld in the first compartment.

According to one embodiment, the pressure in the first and second compartments before the countermass has left the barrel is in the range from 20 MPa to 90 MPa, preferably from 50 MPa to 70 MPa.

According to one embodiment, the pressure in the first compartment after the countermass has left the barrel is in the range from 20 MPa to 90 MPa, for example from 30 MPa to 60 MPa, preferably from 30 MPa to 50 MPa.

According to one embodiment, the pressure in the second compartment after the countermass has left the barrel is in the range from 1 MPa to 10 MPa, preferably from 1 MPa to 5 MPa.

According to one embodiment, the first propellant is preferably of a neutrally burning shape and high energy double base propellant, preferably with a web that renders a burn time of 3 ms to 8 ms. Typically, the burn rate and the demand for low mass flow at the muzzle exit will limit the amount of impulse given in this phase.

According to one embodiment, the second propellant can be of a neutrally burning shape and high energy double base propellant, preferably with a web that renders a burn time of 2 ms to 5 ms. This charge can preferably be slightly progressive to improve the total system efficiency. Preferably, this charge will contain the major part of the total impulse energy rendered in the launch phase.

According to one embodiment, the strength of the barrel must withstand an internal overpressure in the range from 5 MPa to 15 MPa.

According to one embodiment, by appropriate selection of propellant, thickness and particle size of the propellant, smallest section of the opening, preferably the nozzle, and volume of the first compartment, the projectile may be accelerated in a desired manner during the remaining portion of the barrel plus, preferably, if a cartridge case is arranged inside the barrel, the length of the cartridge case which then function as an extended portion of the barrel. Preferably, this is enabled by means of a sealing between such cartridge case and the barrel at the rearmost part of the cartridge case.

According to one embodiment, the cartridge case radially encloses components a) to d).

According to one embodiment, a flight motor, typically a trajectory rocket motor, may be integrated in the projectile in front of the rocket motor, e.g. as disclosed in EP 1 337 750 which can be used during the external ballistics phase. The flight motor may be used as a booster or as a sustainer to extend the trajectory of the projectile. Preferably, a membrane or other barrier is arranged between the launch rocket motor and the flight motor to ensure the ignition of the flight motor is delayed for reasons of security. In order to prevent the gunner being harmed by ignition of a trajectory rocket motor after the projectile has left the barrel, a certain delay time is provided before the flight motor is ignited. According to one embodiment, a multi-stage rocket with a plurality of successive rocket motors arranged one after the other may be provided. According to one embodiment, each rocket motor in an ignition sequence depends on being initiated in connection with a preceding rocket motor burning out via a sequential ignition system.

According to one embodiment, a third compartment comprising a third propellant is arranged in the flight motor. Preferably, the third propellant is ignited in the external ballistics phase after 0.05 to 0.2 seconds. Preferably, the burning time for the third propellant ranges from 1 to 1.5 second. By means of a flight sustainer motor, the velocity of the projectile can be maintained and retardation may be reduced. The sensitivity against wind may be compensated for by means of the sustainer motor.

The present invention also relates to a launcher comprising a barrel accommodating a. a projectile;
b. a rocket motor at the rear end of the projectile comprising a first compartment containing a first propellant;
c. a countermass at the rear end of the barrel; and
d. a second compartment between the rocket motor and the countermass containing a second propellant wherein said first and second compartments form a high pressure chamber subsequent to firing of the projectile;

According to one embodiment, said second compartment is in communication with said first compartment subsequent to formation of a high pressure chamber following firing.

According to one embodiment, a driving band is positioned between the rearmost section of the cartridge case and the barrel. Thereby, the entire length of the barrel becomes available for acceleration. As the cartridge case is accelerated subsequent to firing, the driving band accompanies the cartridge case inside the barrel.

According to one embodiment, means for affixing the countermass, preferably a disk, pin, or membrane, is arranged at the rearmost section of the countermass, which preferably also affixes the further components in the interior of the cartridge case including the projectile. In view of this, only one release mechanism is necessitated to bring countermass and projectile in motion. According to one embodiment, the countermass and the projectile are released simultaneously or substantially simultaneously as a fixation of the cartridge case to the barrel is broken whereby a balanced acceleration of the projectile and the countermass is obtained. Recoiling forces are also dampened due to the smooth release mechanism provided for.

The invention also relates to a recoilless weapon, wherein the weapon is a supporting weapon, e.g. shoulder-fired, hand-held, platform-mounted or a free-standing weapon.

BRIEF DESCRIPTION OF THE FIGURES

FIGS. 3*a-d* illustrate different sub-phases during the internal ballistics phase.

DESCRIPTION OF THE DRAWINGS

Detailed Description of Various Embodiments

Figure 1A:
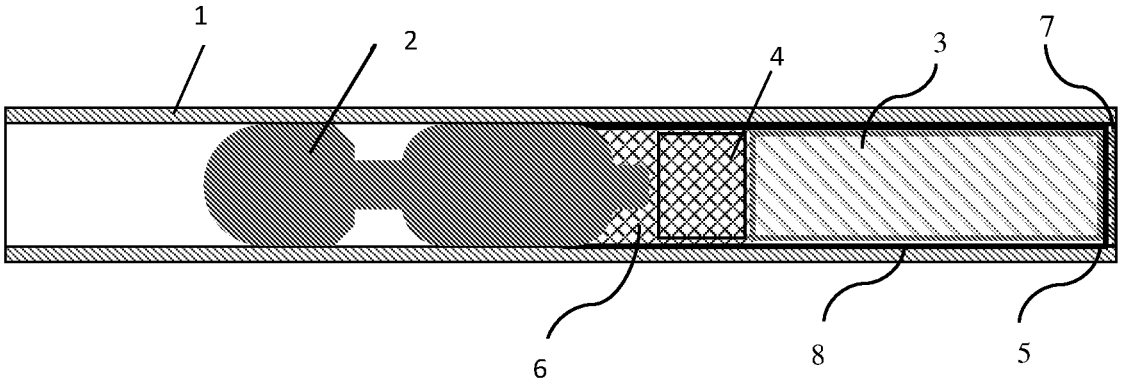
FIG. 1*a* illustrates a barrel accommodating a projectile and a countermass.

FIG. 1*a* illustrates a barrel 1 accommodating a projectile (tandem shell) 2 and a countermass 3 at the rear end of the barrel 1. In FIG. 1*a*, also a propellant case 4 is shown next to the countermass 3. A cartridge case 8 is shown resisting the pressure built up in the forming high pressure chamber 6. The barrel 1 can then be less rigorously designed but needs to resist the pressure remaining at the point in time the projectile 2 and the cartridge case 8 are leaving the barrel 1.

The cartridge case 8 is surrounding the accommodated parts in the barrel 1 extending from the rear end of the projectile 2 to the rear part of the countermass 3. A driving band 5 is arranged at the rearmost section of the barrel contributing to the formation of a high pressure chamber 6 between the projectile 2 and the cartridge case 8. As the driving band 5 is attached to the cartridge case 8 at the rear end thereof, the distance it travels is equal to the length of the barrel 1, in this particular case 980 mm. The countermass 3 consists of steel grit with a total weight of 1 to 4 kg. Means 7 affixing the countermass 3 is arranged at the rear end of the cartridge case 8.

Figure 1B:
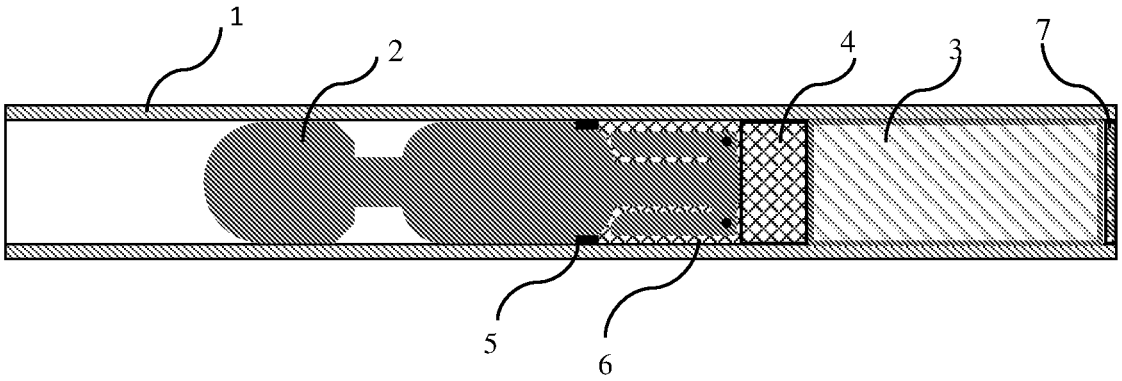
FIG. 1*b* illustrates a conventional arrangement in a barrel accommodating a countermass and a projectile.

FIG. 1*b* illustrates a conventional arrangement in a barrel 1 accommodating a countermass 3 and a projectile 2. As opposed to the arrangement in FIG. 1*a*, the driving band 5 is arranged at the rear part of the projectile 2 whereby the distance it travels is only 430 mm in the same barrel 1, i.e. less than halfway of the driving band 5 in FIG. 1*a*.

Figure 2A:
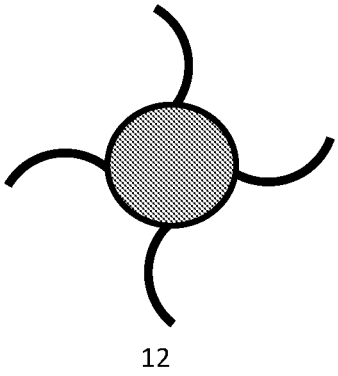
FIGS. 2*a* and 2*b* illustrate a projectile with a cartridge case with wrapped-around fins in unfolded position.
Figure 2B:
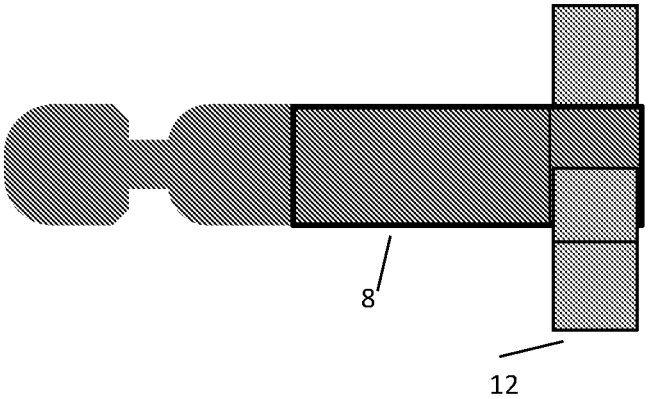

FIGS. 2*a* and 2*b* show a projectile 2 with a cartridge case 8 with wrapped-around fins 12 in unfolded position, seen from behind and from the side respectively. The cartridge case 8 is the same as in FIG. 1*a*. The cartridge case 8 inside the barrel 1 is provided with wrapped-around fins 12 at its rearmost section. The cartridge case 8 may thus function as a holder of fins 12 to which the fins 12 are secured.

Figure 3A:
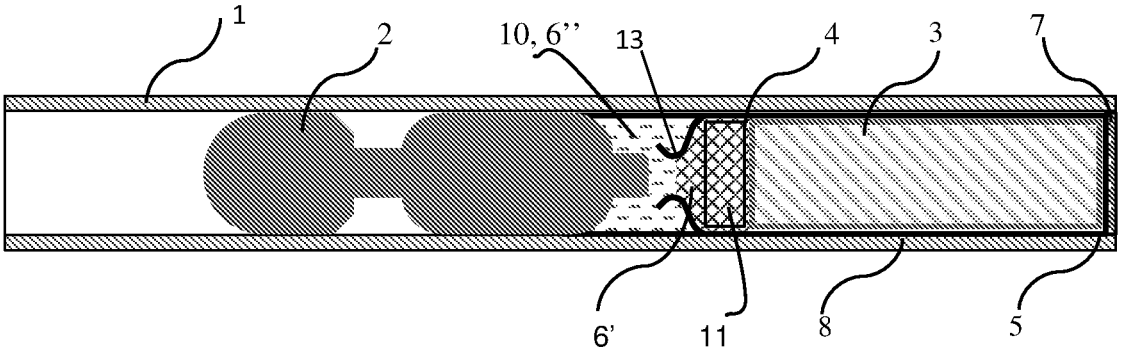
FIG. 3*a* illustrates a barrel accommodating a rocket motor in which a first compartment is arranged.

FIG. 3*a* shows a barrel 1 accommodating a rocket motor 13 in which a first compartment 6" containing a first propellant 10 is arranged between a projectile 2 and a countermass 3 in a cartridge case 8. A second propellant 11 is enclosed in a second propellant case 4. The second propellant 11 is in communication with the first propellant 10 subsequent to firing since a separating lid of the second propellant is burnt and eliminated. The propellant 10 in the first compartment, typically a rocket propellant is ignited subsequent to ignition via the second propellant 11.

Figure 3B:
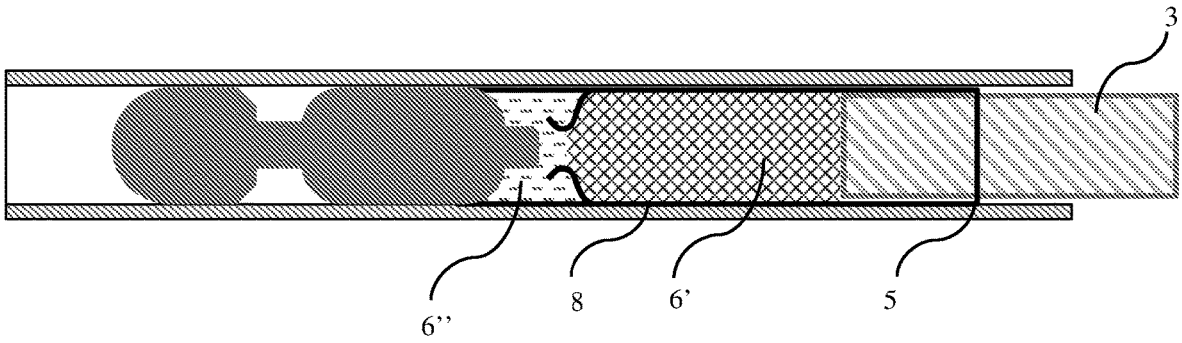
Figure 3C:
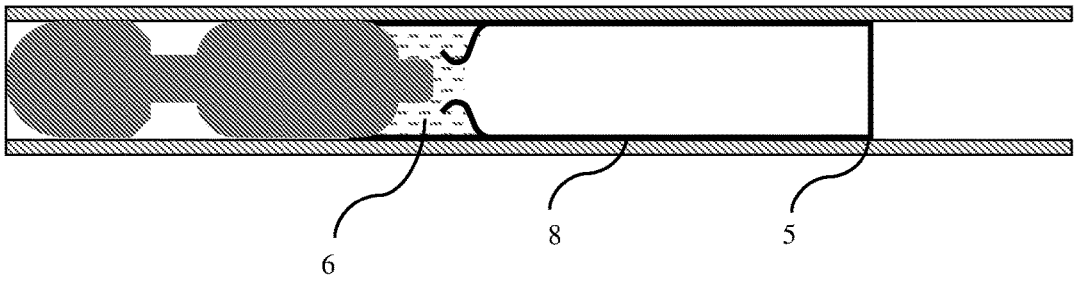
Figure 3D:
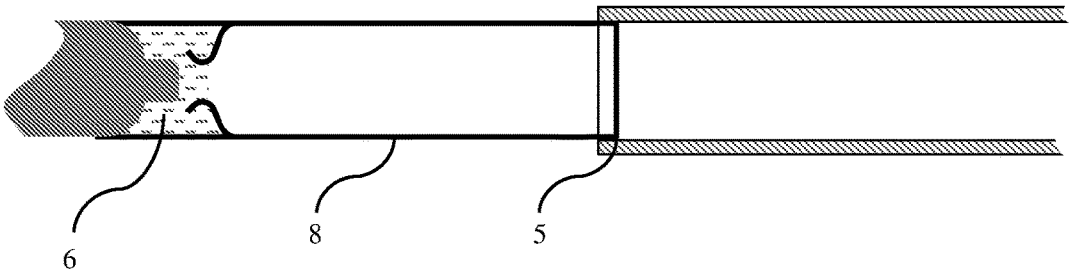

FIGS. 3*a-d* illustrate different sub-phases during the internal ballistics phase. In FIG. 3*a*, prior to ignition of propellant, the countermass 3 is in the rear end of the barrel 1 and all other components are positioned next to one another next to the countermass 3. In FIG. 3*b*, the countermass 3 and the projectile 2 have traveled inside the barrel 1. The countermass 3 is still partially inside the barrel 1 whereby the internal ballistic pressure is upheld in the high pressure chamber 6 made up of compartments 6' and 6". In FIG. 3*c*, the countermass 3 has exited the barrel 1. The rocket motor phase has been initiated. The pressure has dropped considerably in the second compartment 6' whereas an overpressure is still upheld in the first compartment 6" due to propellant combusted in the rocket motor and a rocket motor nozzle restricting the exhaust of combusted propellant. In FIG. 3*d*, the rear part of the cartridge case 8 is about to leave the barrel 1. The propellant should have been combusted prior to the point in time the projectile 2 leaves the barrel 1 for reasons of security of the operator.

Figure 4:
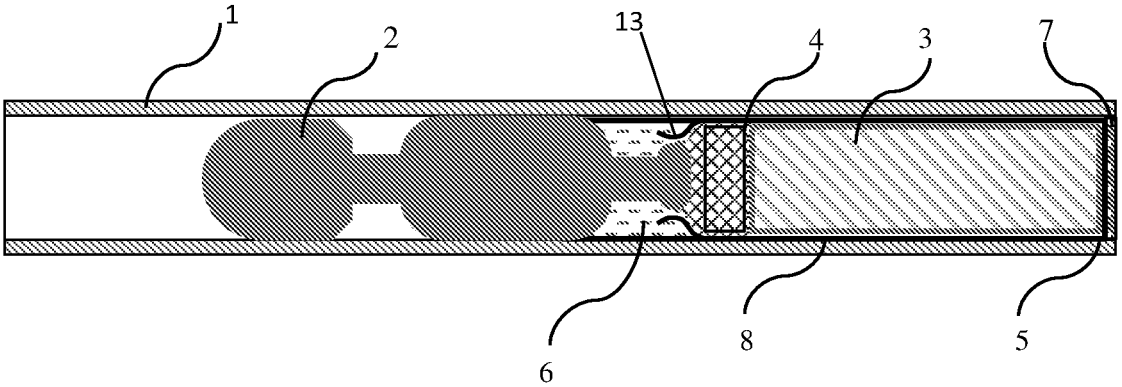
FIG. 4 shows a barrel accommodating a tandem projectile.

FIG. 4 shows a barrel 1 accommodating a tandem projectile 2 equipped with a launch rocket motor 13 formed with a ring nozzle design.

Figure 5:
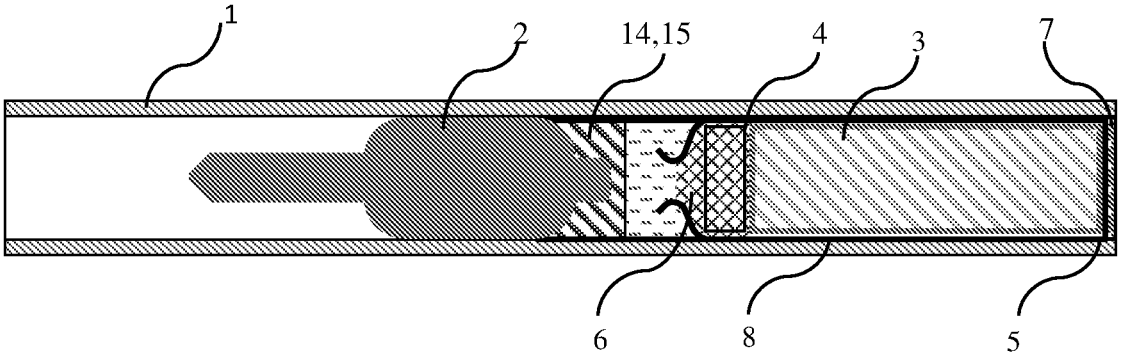
FIG. 5 illustrates a barrel accommodating a flight motor in which a third propellant is enclosed.

FIG. 5 illustrates a barrel 1 accommodating a flight motor 14 in which a third propellant 15 is enclosed. An alternative projectile 2 is illustrated. The flight motor 14 is positioned in front of the launch rocket motor 13 (in FIG. 4) at the rear end of the projectile 2. The flight motor 14 is ignited by an ignition sequence connected to the rocket motor 13.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims.

The invention claimed is:

1. Method for launching a projectile (2) from a barrel (3) accommodating a. a projectile (2);

b. a rocket motor (13) at the rear end of the projectile (2) comprising a first compartment (6") containing a first propellant (10);

c. a countermass (3) at the rear end of the barrel (1); and d. a second compartment (6') between the rocket motor (13) and the countermass (3) containing a second propellant (11), wherein said first and second compartments (6",6') form a high pressure chamber (6) subsequent to firing of the projectile (2);

i) wherein combustion gases originating from propellants contained in said first and second compartments (6",6') in said high pressure chamber (6) accelerate the projectile (2) in the firing direction and the countermass (3) in the opposite direction towards a breech; and ii) wherein the pressure in the high pressure chamber (6) falls in the second compartment to a level below the pressure in the first compartment when the countermass (3) leaves the barrel (1); and iii) wherein said first compartment upholds substantially the originally formed pressure by means of an opening of said first compartment delimiting the exhaust of gases from the first compartment to the second compartment, thus enabling continued acceleration of the projectile (2) after the countermass (3) has exited the barrel (1).

2. Method according to claim 1, wherein the countermass (3) is a metal grit.

3. Method according to claim 1, wherein the opening is a nozzle.

4. Method according to claim 1, wherein the opening is a ring nozzle.

5. Method according to claim 1, wherein a cartridge case (8) radially encloses components a) to d) according to claim 1.

6. Method according to claim 1, wherein a pressure sealing is provided between the cartridge case (8) and the barrel (1) at the rearmost part of the cartridge case (8).

7. Method according to claim 1, wherein a flight motor (14) is integrated in the projectile (2) in front of the rocket motor (13).

8. Launcher comprising a barrel (1) accommodating a. a projectile (2);

b. a rocket motor (13) at the rear end of the projectile (2) comprising a first compartment containing a first propellant;

c. a countermass (3) at the rear end of the barrel (1); and d. a second compartment between the rocket motor (13) and the countermass (3) containing a second propellant, wherein said first and second compartments form a high pressure chamber (6) subsequent to firing of the projectile (2);

wherein a cartridge case (8) is arranged inside the barrel (1) extending from the rear end of the projectile (2) to the rear part of the countermass (3).

9. Launcher according to claim 8, wherein a driving band (5) is positioned between the rearmost part of the countermass (3) and the barrel (1).

10. Launcher according to claim 8, wherein means (7) for affixing the countermass (3) and the cartridge case (8) to the barrel (1) is arranged at the rearmost section of the countermass (3).

11. Launcher according to claim 8, wherein at least three compartments for propellants are arranged between the rear end of the projectile (2) and the countermass (3).

12. A recoilless weapon according to claim 8, wherein the weapon is a hand-held, platform mounted or a free-standing weapon.

* * * * *